United States Patent [19]

Asano et al.

[11] 4,035,248

[45] July 12, 1977

[54] METHOD FOR THE MANUFACTURE OF A STEEL SHEET HAVING A NI-DIFFUSED BASE LAYER WHICH IS TREATED WITH A CHROMIC ACID

[75] Inventors: Hidejiro Asano; Yashichi Oyagi, both of Kitakyushu; Takatoshi Egawa, Nohgata, all of Japan

[73] Assignee: Nippon Steel Corporation, Tokyo, Japan

[21] Appl. No.: 698,565

[22] Filed: June 22, 1976

[30] Foreign Application Priority Data

June 23, 1975 Japan ..... 50-75477

[51] Int. Cl.[2] ..... C25D 5/36

[52] U.S. Cl. ..... 204/38 B; 148/6; 148/12 R; 428/632; 428/667

[58] Field of Search ..... 29/195 T, 196.6; 204/38 B, 37 R, 40, 41; 427/383 C, 383 D, 405

[56] References Cited

U.S. PATENT DOCUMENTS

| | | | |
|---|---|---|---|
| 3,677,797 | 7/1972 | Asano et al. | 29/195 T X |
| 3,849,176 | 11/1974 | Asano et al. | 29/196.6 X |
| 3,894,847 | 7/1975 | Asano et al. | 29/196.6 X |

*Primary Examiner*—G. L. Kaplan
*Assistant Examiner*—William Leader
*Attorney, Agent, or Firm*—Burgess, Dinklage & Sprung

[57] ABSTRACT

A method for treating the surface of a steel sheet adapted for use in making a container or can is provided. A nickel-defused layer is first formed while recrystallization annealing is conducted, upon which layer a film of chromium is plated after temper rolling or double cold rolling. The good lacquer adhesion property of the Cr layer and the good formability of the Ni layer will synergetically act so as to give an excellent anti-corrosion property to a material for cans.

8 Claims, No Drawings

METHOD FOR THE MANUFACTURE OF A STEEL SHEET HAVING A NI-DIFFUSED BASE LAYER WHICH IS TREATED WITH A CHROMIC ACID

DETAILED DESCRIPTION OF THE INVENTION

This invention relates to a method for manufacturing a steel sheet treated with a chromic acid which has an excellent anti-corrosion property.

As is well-known, it is a recent tendency to use, in addition to tin-plate, a steel sheet treated with a chromic acid, that is, a steel which is plated with a metallic chromium and hydrated chromium oxide film for lack of tin resources or because of increase of the cost of tin in the can-manufacturing industry at present.

However, in the case of Cr plated steel sheet, it is a fault that the film of Cr plated is apt to be destroyed when it is subjected to can forming work, as compared with the plated tin film which is soft enough to be used in such forming.

Moreover, the plated Cr film of the steel sheet treated with a bath consisting chiefly of chromic acid has a thickness much thinner than the tin thickness of the tin plate. Furthermore, it does not have such protective action as tin film has for steel when the content of a can is filled. For these reasons, it is customary to apply an organic coating on a steel sheet treated with a bath consisting chiefly of chromic acid. This organic coating is usually applied to a flat steel surface before it is passed to can-making steps where it is shaped into a various type of container or can.

In the course of the can-making steps, it often happens that the organic coating and even the plated film itself are broken or destroyed due to the friction, shock, tension, compression or other external forces. This phenomenon occurs particularly at the part where a severe deformation is given, such as a double seam part of a drink can or a body wall part of a drawn can, which will give rise to various problems. These problems involve the accumulation of Fe ion in the content caused by corrosion of the interior of the can as well as the rust caused by corrosion of the exterior of the can, which will give an adverse effect on maintenance of the quality of the content of the can as well as on various sanitary considerations. Specifically, there is a cumbersome problem of iron dissolution which appears in the vicinity of the double seam portion of the drink can. There is also a problem of deteriorating the anti-corrosion property of the drawn can, which drawn can has received much attention in recent years with respect to such various advantages as economical productivity, good appearance, good sanitation, obviation of soldering, etc.

In order to solve the above problems, it has heretobefore been proposed to change the properties of the hydrated chromium oxide film such as thickness, composition, structure, etc. so as to enhance the adhesion of the paint thereto or the abilities of the film itself, and thereby promote the anti-corrosion property after deformation work of the steel sheet which has been treated with a chromic acid and coated with an organic lacquer. However, the result has proved to be unsatisfactory.

Other attempts have been made to enhance the anti-corrosion property of the plated steel sheet itself as shown in Japenese laid open patent publications 119836/74, 104844/74, etc. in which the Ni-plating is effected as a base of tin-plate. The former application is directed to enhance the anti-corrosion property of the tin-plate can made by ironing work. The latter application is directed to enhance the formability of the can at the time of ironing work. The methods as disclosed in these applications are thus concerned with the base treatment for the tin-plating, which should be distinguished from the method of this invention. Still another method of the base treatment for the tin-plating is disclosed in Japanese laid open patent publication 123443/74, in which tin-plating is effected upon the Ni-diffused layer. More specifically, it involves a method of preliminarily effecting a metallic nickel plating on a steel sheet by the technic of electric plating or conversion coating and allowing the same to diffuse at the time of annealing. In case of allowing the metallic Ni-plating layer preliminarily existing on a steel sheet to diffuse by means of annealing, a diffusion reaction between Fe and Ni proceeds rapidly until the recrystallization of the steel is completed because the diffusion reaction between Fe and Ni will occur very easily. As a result, the concentration of Ni in the surface of the steel sheet is diluted steadily, whereby there is a disadvantage that a great amount of Ni should be required to form a Ni-diffused layer having a thickness enough to prevent corrosion.

After various studies the inventors have now succeeded in solving the above stated disadvantages incidental to the prior art, that is, in enhancing the anti-corrosion property of the steel sheet after can forming work without injuring the good paint adhesion property which is the merit of the chromium-acid-treated steel sheet. This can be done by effecting thermal decomposition and reduction of a Ni compound together with the recrystallization annealing of a thin steel sheet, allowing the Ni to diffuse in the surface of the steel sheet while the annealing is completed, effecting the temper rolling, etc., and thereafter subjecting the steel sheet to a treatment with a bath consisting chiefly of a chromic acid.

It is therefore an object of this invention to provide an improved method for the manufacture of a steel sheet material to be preferably used for a container or can having the Ni-diffused layer as the base.

It is another object of this invention to provide an improved method for the manufacture of a steel sheet material to be preferably used for a container or can which effectively combines the desirable formability of the Ni-diffused base layer with the desirable coatability or lacquerability of the Cr-acid-treated upper layer.

According to this invention, there is provided a method for the manufacture of a steel sheet having a Ni-diffused base layer which is treated with a bath consisting chiefly of chromic acid, comprising (1) coating an aqueous solution containing Ni ion on a surface of steel sheet as cold rolled in the step of manufacturing a thin steel sheet, followed by drying, (2) thereafter subjecting the same to recrystallization annealing while simultaneously allowing the coated Ni compound to be reduced on the surface of the steel sheet, (3) and thereafter plating thereon a film of metallic chromium and/or hydrated chromium oxide by electrolysis using a bath consisting chiefly of a chromic acid.

In this invention, it may be possible to effect a temper rolling or double cold rolling under the reduction rate of 0.1 to 60% after reducing of Ni compound but before treatment with a bath consisting chiefly of chromic acid. In this case if the reduction rate is less than 0.1%, the stretcher strain can not be prevented so that the appearance of the product formed may be injured. On the other hand, if it is more than 60%, the formability to a can can not be obtained.

In this invention, the mechanism of forming the Ni-diffused layer is quite different from that of the conventional method. The rate of reduction of the Ni compound is slower than the rate of recrystallization of the steel whereby a desirable amount of the Ni-diffused layer can be easily obtained with a lesser amount of Ni. It means that, in case of applying the same amount of Ni to the surface of a steel sheet, a more excellent anti-corrosion property can be obtained by the Ni-diffused layer according to this invention as compared with that of the prior art.

The Ni compound which is used in the practice of this invention may be nickel acetate, nickel nitrate, nickel formate, nickel oxalate, nickel carbonate, and the like. The range of concentration of the aqueous solution may be about 10 to 100 g/l, depending upon the solubility of the particular Ni compound used. In this case it is preferable that the concentration be as large as possible in order to decrease the heat capacity for drying after coating with aqueous solution. The thickness of the diffusion of Ni may be about 1 $\mu$ or less, and the amount of Ni attached may be about 0.2 to 5.0 mg/dm$^2$. The cold rolling step including temper rolling to be held after the Ni treatment is intended to correct the strength or the shape of the material sheet. Thereafter, a treating bath containing a chromic acid as a main component is used to plate a film of metallic chromium and/or hydrated chromium oxide on the material according to an electrolytic process. The amount of metallic chromium attached may be about 0.3 to 1.0 mg/dm$^2$ while that of chromate may be about 0.2 mg/dm$^2$ or less.

When the Ni is heretofore used as the base of the tin-plate, the alloying reaction between Ni and Sn occurs easily in the paint-baking temperature range of the order of 200° C and the resulting alloying layer displays an excellent anti-corrosion property. However, in case of a steel sheet treated with a chromic acid, the alloying reaction between Ni and Cr does not occur in such low temperature range. Accordingly, the effect of improved anti-corrosion property given thereby depends upon the Cr-plated layer itself and the Ni-diffused layer itself, which should be distinguished from the function of the alloying layer of Ni-Sn mentioned above.

The reason why the steel sheet treated with a bath consisting chiefly of chromic acid and having a Ni-diffused layer exert an excellent characteristic in this invention is considered as depending upon the synergetic effect of the excellent lacquer adhesion property of the Cr-containing layer and the excellent formability of the Ni-diffused layer. The excellent formability of the Ni-diffused layer is caused by the fact that said layer does not produce any different phase in the surface of the steel sheet.

An example of this invention is described hereinbelow.

EXAMPLE

In one test, a Ni plating is conducted on a steel sheet by means of an electric plating or by means of a conversion coating, followed by Ni diffusion by annealing. In another test, a Ni compound in aqueous solution is coated on a steel sheet, followed by drying, which is then subjected to annealing in an atmosphere of 6% $H_2$ and $N_2$ while the film is formed thereon. The results of these tests are shown in Table below, in which the samples are prepared as follows:

The steel sheet having a Ni-diffused layer formed in a manner as above is subjected to temper rolling under the reduction rate of 1.5%, which is then coated, in a plating bath consisting chiefly of a chromic acid, with 1.0 mg/dm$^2$ of metallic chromium and then with 0.1 mg/dm$^2$ (calculated as Cr) of hydrated chromium oxide thereon. An epoxy resin paint is coated thereon in an amount of 50 mg/dm$^2$, which is then subjected to a flanging work of 3 mm and 6 mm by the use of an Erichsen testing machine, followed by dipping in an aqueous solution of 1.5% citric acid and 1.5% salt. The resulting amount of dissolved iron is measured.

It is seen from the results shown in Table that the steel sheet obtained by the method of this invention as represented by samples 6 to 8 shows much better properties than that of the other steel sheets.

Table

| Sample No. | Method of Ni-plating | Amount of Ni attached (mg/dm$^2$) | Condition of annealing | Amt. of dissolved iron: Erichsen flanging test 3 mm | Amt. of dissolved iron: Erichsen flanging test 6 mm |
|---|---|---|---|---|---|
| 1 | No Ni-plating | 0 | Temperature kept at 680 °C; | 15 ppm | 80 ppm |
| 2 | Substitu-plating | 1.0 | | 3 | 15 |
| 3 | " | 2.0 | | 2 | 7 |
| 4 | Electric plating | 1.0 | time kept for 30 sec; | 3 | 10 |
| 5 | " | 2.0 | | 2 | 6 |
| 6 | Nickel acetate coating | 1.0 | | 1 | 3 |
| 7 | Nickel nitrate coating | " | Annealing atmosphere ($H_2$ 6% $N_2$ rest) | 1 | 4 |
| 8 | Nickel formate coating | " | | 1 | 3 |

We claim:

1. A method for the manufacture of a steel sheet having a Ni-diffused base layer which is treated with a bath consisting chiefly of chromic acid, comprising (1) coating an aqueous solution containing Ni ion on a surface of steel sheet as cold rolled in the step of manufacturing a thin steel sheet, followed by drying, (2) thereafter subjecting the same to recrystallization annealing while simultaneously allowing the coated Ni compound to be reduced on the surface of the steel sheet, (3) and thereafter plating thereon a film of metallic chromium and/or hydrated chromium oxide by electrolysis using a bath consisting chiefly of a chromic acid.

2. A method according to claim 1 wherein the Ni ion is supplied by a compound selected from the group consisting of nickel acetate, nickel nitrate, nickel formate, nickel oxalate and nickel carbonate.

3. A method according to claim 1 in which the concentration of a compound supplying the nickel ion is about 10 to 100 g/l in said aqueous solution.

4. A method according to claim 1 in which the amount of Ni attached is about 0.2 to 0.5 mg/dm$^2$.

5. A method according to claim 1 in which the amount of metallic chromium attached is about 0.3 to 1.0 mg/dm$^2$.

6. A method according to claim 1 in which the amount of hydrated chromium oxide attached is about 0.2 mg/dm$^2$ or less.

7. A method according to claim 1 in which the amount of Ni attached is about 0.6 to 2.0 mg/dm$^2$.

8. A method according to claim 1 in which said steel sheet is temper rolled or double cold rolled under a reduction rate of 0.1% to 60% after annealing and reducing thereof but before Cr-plating thereon.

* * * * *